US010438558B2

(12) United States Patent
Tsai

(10) Patent No.: US 10,438,558 B2
(45) Date of Patent: Oct. 8, 2019

(54) DRIVING METHOD OF VISUAL INTERFACE SYSTEM

(75) Inventor: Hsiung-Kuang Tsai, Taipei (TW)

(73) Assignee: SLIM HMI TECHNOLOGY, Taipei (TW)

( * ) Notice: Subject to any disclaimer, the term of this patent is extended or adjusted under 35 U.S.C. 154(b) by 95 days.

(21) Appl. No.: 14/348,592

(22) PCT Filed: Sep. 30, 2011

(86) PCT No.: PCT/CN2011/080394
§ 371 (c)(1),
(2), (4) Date: Mar. 28, 2014

(87) PCT Pub. No.: WO2013/044491
PCT Pub. Date: Apr. 4, 2013

(65) Prior Publication Data
US 2014/0306917 A1 Oct. 16, 2014

(51) Int. Cl.
*G09G 5/00* (2006.01)
*G09G 3/20* (2006.01)
*G09G 3/36* (2006.01)

(52) U.S. Cl.
CPC ..... *G09G 5/003* (2013.01); *G09G 3/20* (2013.01); *G09G 3/3648* (2013.01); *G09G 2300/08* (2013.01); *G09G 2354/00* (2013.01)

(58) Field of Classification Search
None
See application file for complete search history.

(56) References Cited

U.S. PATENT DOCUMENTS 5,767,936 A * 6/1998 Sugimura ..... G02F 1/13318 349/116
2002/0008898 A1* 1/2002 Katase ..... G02F 1/167 359/296

(Continued)

FOREIGN PATENT DOCUMENTS

CN 101738772 A 6/2010
CN 101930320 A 12/2010

(Continued)

OTHER PUBLICATIONS

"Near Field Communication—Interface and Protocol (NFCIP-1)", Standard ECMA-340, ECMA International Standardizing Information and Communication Systems, Dec. 2002.

*Primary Examiner* — Andre L Matthews
(74) *Attorney, Agent, or Firm* — Muncy, Geissler, Olds & Lowe, P.C.

(57) ABSTRACT

A driving method of a visual interface system is disclosed. The visual interface system includes an operation apparatus and a matrix display apparatus having a display surface and a matrix substrate. The matrix substrate has a substrate and a matrix disposed at one side of the substrate while the display surface is located at another side of the substrate. The driving method includes steps of: transmitting a plurality of encoded signals and a plurality of display signals by the matrix substrate of the matrix display apparatus; and receiving at least one of the encoded signals by the operation apparatus operating on the display surface. This approach allows the visual interface system to be equipped with display and communication functions without configuring an additional touch input panel, so that the products can be lighter and thinner and have lower manufacturing cost.

15 Claims, 10 Drawing Sheets

(56) References Cited

U.S. PATENT DOCUMENTS

| | | | | |
|---|---|---|---|---|
| 2003/0197691 | A1* | 10/2003 | Fujiwara | G06F 3/03545 345/179 |
| 2010/0188347 | A1* | 7/2010 | Mizuhashi | G02F 1/13338 345/173 |
| 2010/0194707 | A1* | 8/2010 | Hotelling | G06F 3/0412 345/173 |
| 2010/0252335 | A1* | 10/2010 | Orsley | G06F 3/044 178/18.03 |
| 2011/0059692 | A1 | 3/2011 | Hyoung et al. | |
| 2011/0193798 | A1 | 8/2011 | Zhan et al. | |
| 2011/0227871 | A1 | 9/2011 | Cannon | |
| 2011/0291986 | A1* | 12/2011 | Rebeschi | G06F 3/044 345/174 |

FOREIGN PATENT DOCUMENTS

| | | | |
|---|---|---|---|
| CN | 201725303 | U | 1/2011 |
| CN | 102298473 | A | 12/2011 |
| EP | 2172834 | A2 | 4/2010 |
| JP | 6-318136 | A | 11/1994 |
| JP | 9-204272 | A | 8/1997 |
| JP | 2000-322199 | A | 11/2000 |
| JP | 2001-75074 | A | 3/2001 |
| JP | 2004-5415 | A | 1/2004 |
| JP | 2010-286895 | A | 12/2010 |
| TW | 200402684 | A | 2/2004 |
| TW | 200928504 | | 7/2009 |
| TW | 201113775 | A | 4/2011 |
| WO | 2010/138485 | A1 | 12/2010 |

* cited by examiner

DRIVING METHOD OF VISUAL INTERFACE SYSTEM

BACKGROUND OF THE INVENTION

Field of Invention

The present invention relates to a driving method and, in particular, to a driving method of a visual interface system.

Related Art

Recently, touch panels have been widely applied to the commercial electronic products such as mobile phones, digital cameras, MP3, PDA, GPS, tablet PC, UMPC, TV and the likes. In these electronic products, the touch panel is bound with a screen to form a touch input display apparatus. The manufacturing method of a conventional touch input display apparatus is to dispose a touch panel on a display panel of a display module. However, due to the additional touch panel, this approach increases not only the weight and size of the product, but also the cost.

On the other hand, in order to expand the applications of the commercial electronic products, some products have been added with the new function of near field communication (NFC) which, for example, can be used in situation to replace the conventional IC cards (e.g. access control, credit card, and ticket, etc.) or to exchange information (e.g. music, image, and name card etc.) between two electronic devices. Accordingly, it is desirable to create a concise architecture which, without adding extra components, can provide these functions.

Therefore, it is an important subject to provide a driving method of a visual interface system which can achieve the desired touch input function without configuring an additional touch panel to the visual interface system, thereby making the product lighter and thinner, lowering the production cost, and providing the short distance wireless communication function for expanding the application.

SUMMARY OF THE INVENTION

An objective of the present invention is to provide a driving method of a visual interface system that allows the visual interface system to be equipped with display, input, and communication functions without configuring an additional touch input panel, so that the products can be lighter and thinner and have lower manufacturing cost.

The present invention can be implemented by the following technical proposals.

The invention discloses a driving method of a visual interface system. The visual interface system includes an operation apparatus and a matrix display apparatus having a display surface and a matrix substrate. The matrix substrate has a substrate and a matrix disposed at one side of the substrate while the display surface is located at another side of the substrate. The driving method includes steps of: transmitting a plurality of encoded signals and a plurality of display signals by the matrix substrate of the matrix display apparatus; and receiving at least one of the encoded signals by the operation apparatus operating on the display surface.

In one embodiment, the encoded signals are capacitively coupled to the operation apparatus from the matrix substrate.

In one embodiment, the encoded signals comprise touch input information, instruction information, identification information, transaction information, or file information.

In one embodiment, the encoded signals are encoded by frequency, or amplitude, or phase, or time difference.

In one embodiment, the encoded signals are transmitted through a plurality of row electrodes or a plurality of column electrodes of the matrix substrate. Herein, the encoded signals are sequentially or simultaneously transmitted through the row electrodes or the column electrodes.

In one embodiment, a part of the column electrodes transmits the same encoded signals.

In one embodiment, the encoded signals transmitted through the row electrodes and the encoded signals transmitted through the column electrode are encoded by different coding methods.

In one embodiment, the encoded signals are transmitted between the display signals.

In one embodiment, the encoded signals are transmitted during the breaking time of the display signals, and the breaking time is, for example, within an image frame or between image frames.

In one embodiment, each encoded signal includes a start code or an end code.

In one embodiment, the matrix display apparatus is enabled to enter a transmission mode so as to transmit the encoded signals by triggering a transmission mode switch.

In one embodiment, the driving method further includes steps of: obtaining a touch input information according to the encoded signals; and activating the matrix display apparatus according to the touch input information.

As mentioned above, a plurality of encoded signals and a plurality of display signals are transmitted on the matrix substrate by the matrix display apparatus, wherein the display signals are used to control the matrix substrate to display images, while the encoded signals can incorporate the touch input function, data transmission function or other functions (e.g. user identification function) into the matrix substrate. When the operation apparatus is operated on the display surface, the encoded signals are coupled from the matrix substrate to the operation apparatus. The encoded signals are then processed to obtain the touch input information, instruction information, identification information, transaction information, or file information. As a result, the visual interface system of the invention can be directly applied to the matrix substrate such as TFT substrate of LCD panel, OLED panel, LED panel, electrophoretic display panel, MEMS display panel, or the likes, thereby making the products lighter, thinner and cheaper so as to increase the product competitiveness. Moreover, the encoded signals are coupled to the external operation apparatus instead of being directly sensed by the matrix substrate, so that it is unnecessary to modify the layout on the matrix substrate. For example, it is unnecessary to add the capacitance sensing components in the display panel for detecting the change of external capacitance values. As a result, the present invention can decrease the manufacturing cost and shrink the process time.

DETAILED DESCRIPTION OF THE INVENTION

A driving method of a visual interface system according to a preferred embodiment of the present invention will be apparent from the following detailed description, which proceeds with reference to the accompanying drawings, wherein the same references relate to the same elements.

Figure 1:
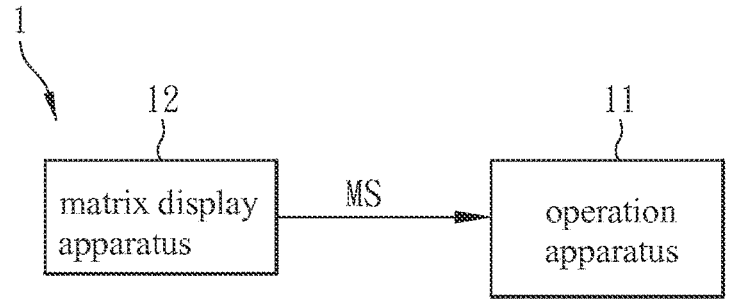
FIG. 1 is a block diagram showing a visual interface system according to a preferred embodiment of the invention.

A driving method according to a preferred embodiment of the invention is applied to a visual interface system. FIG. 1 is a block diagram showing a visual interface system 1 according to a preferred embodiment of the invention. The visual interface system 1 includes an operation apparatus 11 and a matrix display apparatus 12, which are coupled to each other. For example, the operation apparatus 11 and the matrix display apparatus 12 can be coupled capacitively for transmitting signals. Besides, the output of the operation apparatus 11 may connect to other units of the system through wire or wireless electrical coupling or optical coupling.

Figure 2:
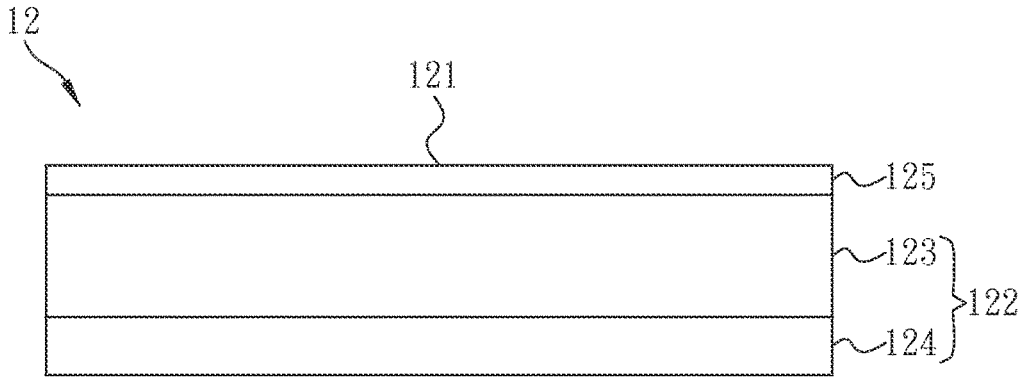
FIG. 2 is a side view of the matrix display apparatus of the visual interface system according to the embodiment of the invention.

FIG. 2 is a side view of the matrix display apparatus 12. As shown in FIG. 2, the matrix display apparatus 12 includes a display surface 121 and a matrix substrate 122. The matrix substrate 122 includes a substrate 123 and a matrix 124. The matrix 124 is disposed at one side of the substrate 123, while the display surface 121 is located at the other side of the substrate 123. Compared with the conventional matrix substrate of the LCD apparatus, the matrix substrate 122 of the invention is reversed. That is, compared with the color filter substrate, the substrate 123 of the matrix substrate 122 can serve as the display surface 121, which is closer to the viewers. In this embodiment, the display surface 121 is the surface of the matrix display apparatus 12, which is closest to the viewer when the viewer is watching the images displayed on the matrix display apparatus 12. Besides, the matrix display apparatus 12 may further include a protect glass 125 disposed on one side of the substrate 123 opposite to the matrix 124. In this case, the display surface 121 is the surface of the protect glass 125 closest to the viewer. Moreover, it is possible to configure other components, such as polarizer, between the substrate 123 and the protect glass 125.

In this embodiment, the matrix substrate 122 is a substrate or panel configured with pixel matrix for displaying images, such as the TFT substrate of LCD panel, OLED panel, inorganic LED panel, electrophoretic display matrix panel, MEMS display panel, and the likes. The matrix 124 includes a plurality of row electrodes, a plurality of column electrodes, and a plurality of pixel electrodes, wherein the row electrodes and the column electrodes are intersected. Moreover, the matrix 124 can be an active matrix or a passive matrix. In this embodiment, the matrix 124 is an active matrix for example. Besides, the matrix 124 may further include a plurality of transistors electrically connected with the row electrodes, the column electrodes and the pixel electrodes, respectively.

Figure 3:
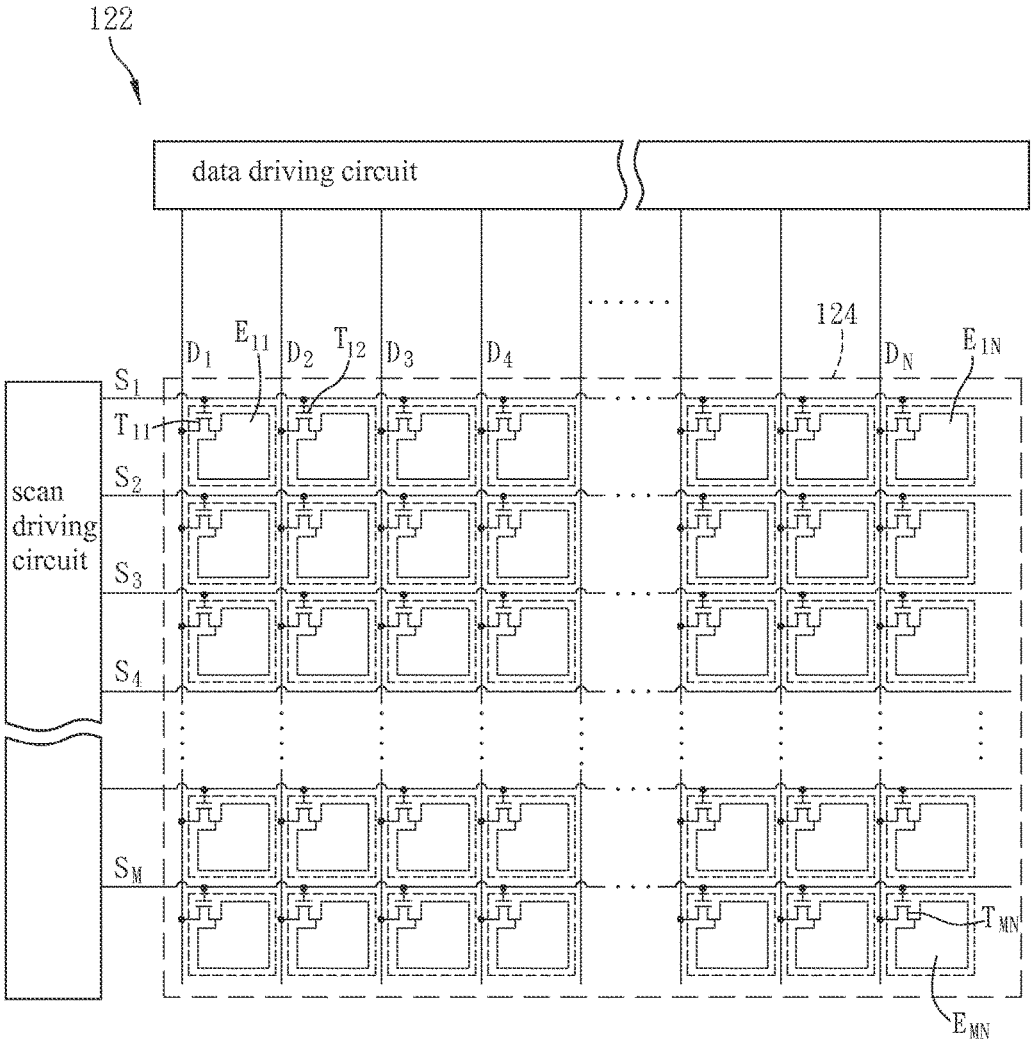
FIG. 3 is a schematic diagram showing matrix substrate according to the embodiment of the invention, wherein the matrix substrate is a TFT substrate.

FIG. 3 is a schematic diagram showing matrix substrate according to the embodiment of the invention, wherein the matrix substrate is a TFT substrate. The matrix 124 includes a plurality of row electrodes $S_1$~$S_M$, a plurality of column electrodes $D_1$~$D_N$, and a plurality of pixel electrodes $E_{11}$~$E_{MN}$. The row electrodes $S_1$~$S_M$ and the column electrodes $D_1$~$D_N$ are intersected and they are substantially perpendicular to each other or have an included angle. Moreover, the matrix 124 further includes a plurality of transistors $T_{11}$~$T_{MN}$ for electrically connected with the row electrodes $S_1$~$S_M$, column electrodes $D_1$~$D_N$, and pixel electrodes $E_{11}$~$E_{MN}$. The row electrodes $S_1$~$S_M$ are referred to as scan lines, while the column electrodes $D_1$~$D_N$ are referred to as data lines. Besides, the substrate 123 may further be configured with a driving module, which includes data driving circuit, scan driving circuit, timing control circuit (not shown), and gamma calibration circuit (not shown), for driving the LCD panel to display images. Since the function of the driving module is well known in this art, the detailed description thereof will be omitted here. To be noted, the above-mentioned matrix substrate 122 is for illustrations only and is not to limit the invention.

Figure 4:
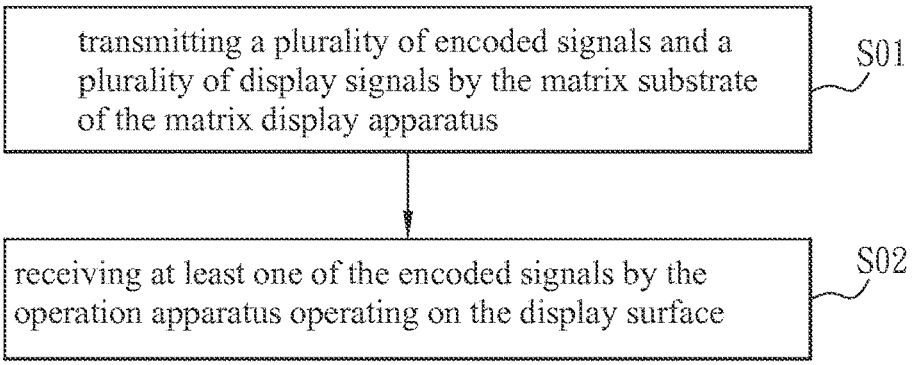
FIG. 4 is a flow chart of a driving method of the visual interface system according to the embodiment of the invention.

FIG. 4 is a flow chart of a driving method of the visual interface system 1 according to the embodiment of the invention. The driving method includes the following steps S01 and S02. The driving method of the visual interface system 1 will be further described hereinafter with reference to FIGS. 1 to 4.

The step S01 is to transmit a plurality of encoded signals and a plurality of display signals by the matrix substrate 122 of the matrix display apparatus 12. The display signals are used to control the matrix display apparatus 12 to display images. For example, the display signals may include scan signals and/or data signals, which are transmitted through the row electrodes $S_1$~$S_M$ and the column electrodes $D_1$~$D_N$, respectively.

The encoded signals can be transmitted through the independent electrode of the matrix substrate 122, which is not related to display, or multiple row electrodes $S_1$~$S_M$, or multiple column electrodes $D_1$~$D_N$, or some row electrodes $S_1$~$S_M$ and some column electrodes $D_1$~$D_N$. The encoded signals can be encoded by, for example, frequency, amplitude, phase, CDMA (code division multiple access) or time difference. Besides, the encoded signals may include touch input information, instruction information, identification information, transaction information, file information, or other information. Depending on the function to be established between the operation apparatus 11 and the matrix display apparatus 12, the information is encoded by a specific coding method so as to generate the encoded signals. For example, the touch input information can establish the touch input function between the operation apparatus 11 and the matrix display apparatus 12. The identification information allows the operation apparatus 11 and the matrix display apparatus 12 to recognize the user identification, which can be applied to access control. The transaction information can be used in the activity of a financial transaction between two members who own the operation apparatus 11 and the matrix display apparatus, respectively. The file information can be used to transmit a file, such as pictures, music, and etc., from the matrix display apparatus 12 to the operation apparatus 11. The related descriptions will be illustrated hereinafter.

The encoded signals are sequentially transmitted through the row electrodes or column electrodes of the matrix substrate 122, or simultaneously transmitted through the row electrodes or column electrodes of the matrix substrate 122. In order to identify the encoded signals transmitted from the row electrodes and the column electrodes, the encoded signals transmitted through the row electrodes and the encoded signals transmitted through the column electrode can be encoded by different coding methods. For example, the encoded signals can be modulated by frequency modulation, amplitude modulation, phase modulation, time modulation, or code modulation. For example, the encoded signals are transmitted through the row electrodes and the column electrodes at different timings, or the encoded signals transmitted through the row electrodes are encoded by frequency, while the encoded signals transmitted through the column electrodes are encoded by amplitude. Besides, part of the column electrodes or the row electrodes may transmit the same encoded signals simultaneously. In other words, several column electrodes and several row electrodes are set as a group for transmitting the same encoded signals. This can be applied to the circumstance when the electrode width of the row electrodes or the column electrodes is small.

The encoded signal can be transmitted between display scenes (for example occupy several display frames periods), or during the breaking time of the display signals, or between the display line and alternating with the display signal. Herein, the breaking time is between two frames. To be noted, the tolerance to the influence of the display quality caused by the encoded signal depends on the application. For example, when the encoded signals are used for touch input application, the flickering image is a considerable issue, so that the encoded signals should be transmitted during the breaking time or within each display line. In addition, when the encoded signals are used in communication for temporary purpose, it is possible to stop displaying and to transmit encoded signals only. Or, the encoded signal can have a higher frequency and be directly added to the display signal, like a carrier. Since the encoded signal has higher frequency than the display signal, the influence to the display quality can be reduced. Besides, the encoded signal may be a signal without DC component to minimize the influence to the display quality.

The step S02 is to receive at least one of the encoded signals by operating the operation apparatus 11 on the display surface 121. The encoded signal can be, for example, capacitively coupled from the matrix substrate 122 to the operation apparatus 11. The operation apparatus is, for example, a stylus, the hand of a user, or a receiving device such as a card reader. When the operation apparatus 11 is operated on the display surface 121 (the operation apparatus 11 may touch, approach or non-touch the display surface 121), the encoded signals on the row electrode or column electrode can be capacitively coupled from the electrodes, of matrix substrate 122, closer to the operation apparatus 11.

After receiving the encoded signals, the operation apparatus 11 can process the encoded signals in various ways to retrieve the information contained in the encoded signals, such as the touch input information or the user identification information. The encoded signals can be processed by the operation apparatus 11 to generate the final information, which can be further wired or wirelessly transmitted to other systems or apparatuses for conducting the desire actions. Or, the encoded signals can be directly sent back to the matrix display apparatus 12, which processes the received encoded signal to obtain the final information. Then, the matrix display apparatus 12 can operate according to the final information or transmit it to other systems or apparatuses. Besides, the encoded signals can be processed intermediately by the operation apparatus 11, such as amplification or filtering, and then transmitted to other systems, apparatuses, or the matrix display apparatus 12 for further processing to generate the final information. Or, it is also possible to add an additional unit (e.g. between the operation apparatus 11 and the matrix display apparatus 12) in the visual interface system 1 for processing the output of the operation apparatus 11 and transmitting the result to other systems, apparatuses or the matrix display apparatus 12. This unit can also be configured to involve in processing the encoded signals.

The driving method further includes a step of obtaining information according to the encoded signals, wherein the information includes touch input information, instruction information, identification information, transaction information, file information, or other information. If the encoded signals contain touch input information, it is possible to obtain the touch input information after processing the encoded signals, thereby controlling the matrix display apparatus 12 according to the touch input information.

Some exemplary embodiments will be described hereinafter for illustrating the encoded signals.

Figure 5A:
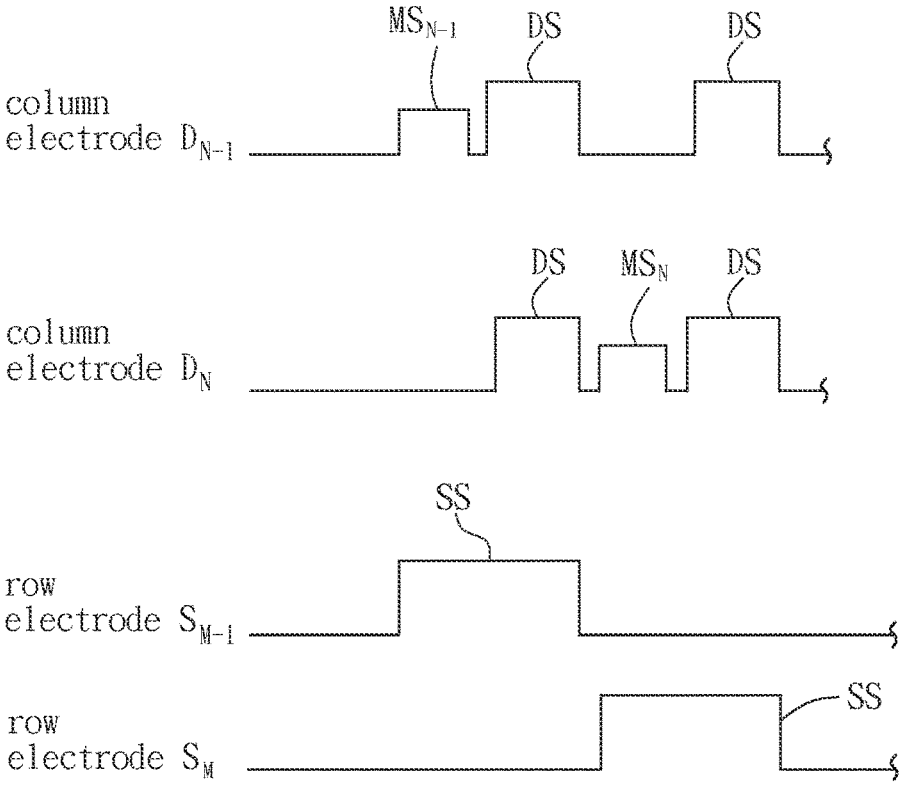
FIGS. 5A to 11 are schematic diagrams showing different aspects of encoded signals used in the driving method of the invention.

FIG. 5A is a schematic diagram of the sequentially encoded transmitting signals. It shows the signals of two adjacent row electrodes ($S_{M-1}$, $S_M$) and column electrodes ($D_{N-1}$, $D_N$). The row electrodes $S_1$~$S_M$ transmit scan signals SS for sequentially enabling the transistors of each row. After the rows of transistors are enabled, the column electrodes $D_1$~$D_N$ output the encoded signals MS and the display signals DS. In this embodiment, as shown in FIG. 5A, when a row electrode transmits the scan signal, only one column electrode transmits the encoded signal MS with different level from the display signal DS. In other words, during the period of row electrode $S_{M-1}$ transmitting the scan signal SS, only the column electrode $D_{N-1}$ transmits the display signal DS and the encoded signal $MS_{N-1}$ with different level from the display signal DS. Similarly, during the period of row electrode $S_M$ transmitting the scan signal SS, only the column electrode $D_N$ transmits the display signal DS and the encoded signal $MS_N$ with different level from the display signal DS.

Figure 5B:
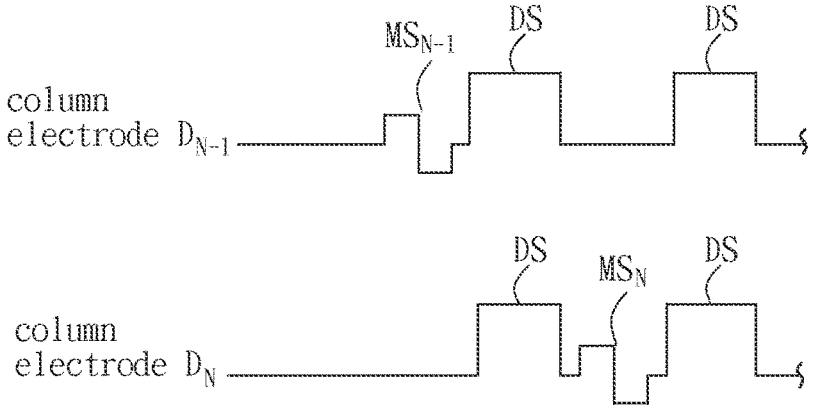

In FIG. 5A, one row electrode only corresponds to one column electrode, but this is not the limitation of the invention. If the signal width is properly defined, it is also possible to perform the one-to-multiple or multiple-to-one approach. For example, when one row electrode is turned on, all column electrodes can output the encoded signals. In addition, the encoded signals ($MS_{N-1}$, $MS_N$) as shown in FIG. 5A may represent an output of (1,1), (0,1), (1,0) or (0,0) according to the order of the row electrodes. To lower the influence to display quality, the signals as shown in FIG. 5B can be applied. Herein, the average of the outputted encoded signals within a unit time contains no DC component so as to prevent the polarization of the liquid crystal molecules in LCD. In view of communication, the sequentially encoded transmitting signals are a TDM (time division multiplexing) communication architecture. This means the communication channel between the transmitting terminal (the matrix display apparatus) and the receiving terminal (the operation apparatus) is assigned to one transmitting source (e.g. the column electrode $D_N$) during a certain time period. Wherein, different time period designates different transmitting source. In other words, if the receiving terminal can recognize transmitting source from the signal, e.g. encoded with time, this methodology can be applied to locate the position in touch input applications. The following example discusses the present invention used in touch input application with reference to FIG. 5A, wherein '1' represents a pulse and '0' represents no pulse.

Figure 6:
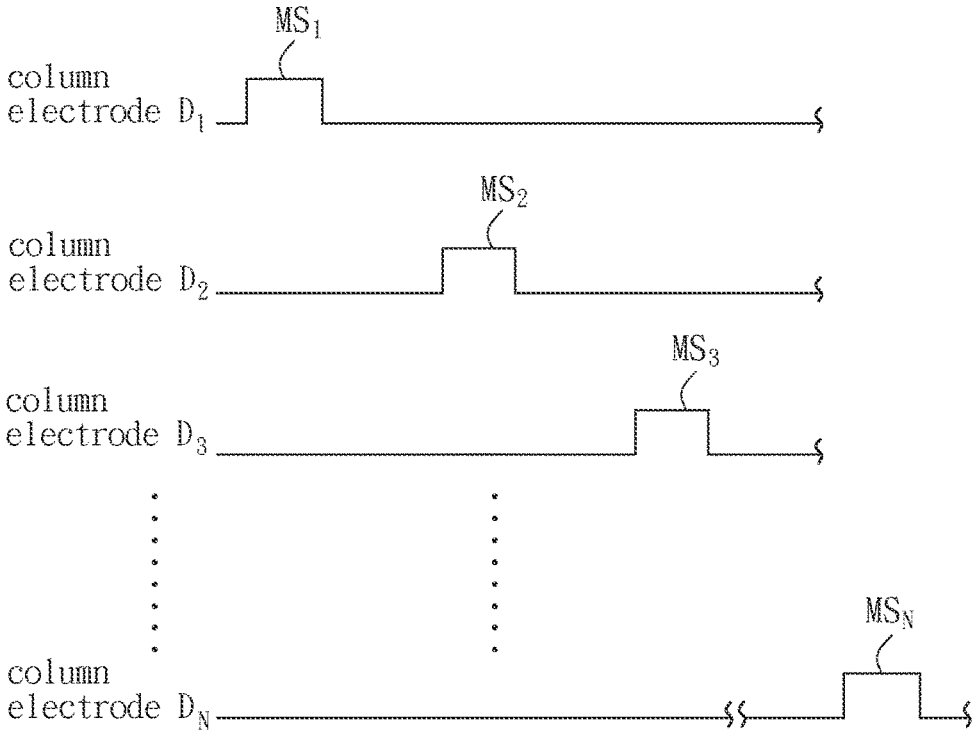

Following FIG. 5A, the timing chart of the encoded signals on the column electrodes $D_1$~$D_N$ is shown in FIG. 6, wherein the display signal DS is omitted. When the row electrodes $S_1$~$S_M$ transmit high level scan signals, the column electrodes $D_1$~$D_N$ transmit the encoded signals $MS_1$~$MS_N$. Since the column electrodes $D_1$~$D_N$ transmit the sequentially encoded signals $MS_1$~$MS_N$, we can figure out which column electrode is touched so as to obtain the X coordinate of the touched position from the encoded signal (such as receiving one of the encoded signals $MS_1$~$MS_N$) obtained by the previous mentioned capacitively coupling. The Y coordinate of the touched position can be obtained from the row electrodes $S_1$~$S_M$. Since the scan signals SS transmitted through the row electrodes $S_1$~$S_M$ are generated sequentially, they are inherently encoded signals. Accordingly, the scan signals SS can be treated as the encoded signals of this invention. This encoded signals can be coupled to the operation apparatus for decoding and thus figure out which row electrode is touched by referring to the sequential turn-on time of the row electrodes $S_1$~$S_M$. Besides, in order to avoid the interference to the display scene during the touch input application, the duty cycle of the encoded signals $MS_1$~$MS_N$ is smaller than that of the display signal DS, thereby remaining the display quality.

Figure 7A:
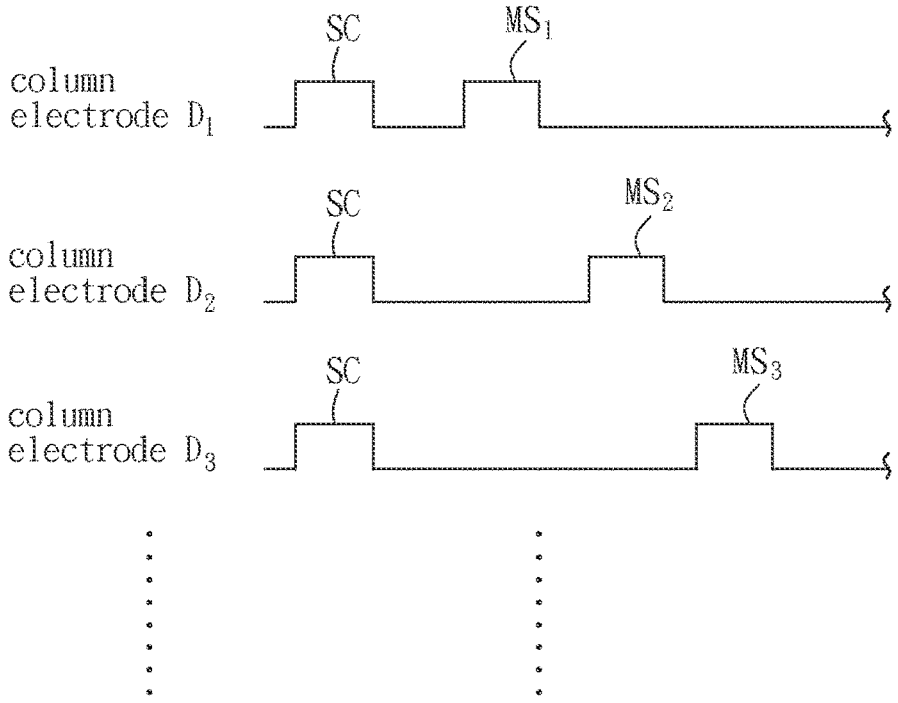
Figure 7B:
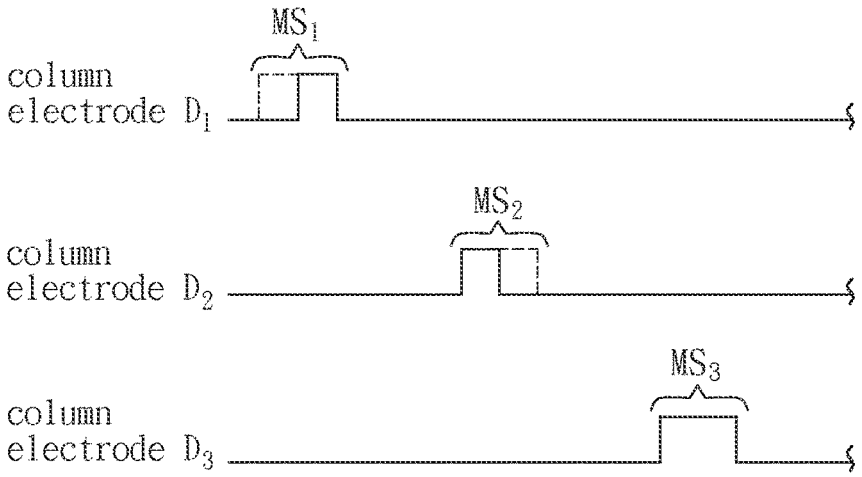

FIG. 7A is a schematic diagram showing the information encoded by time difference, wherein the encoded information is the electrode numbers (for touch input application), and the display signals DS are omitted. Each of the encoded signals $MS_1$~$MS_3$ has a start code SC, and the start codes SC are at same time locations and serve as the start references. Thus, each of the encoded signals $MS_1$~$MS_3$ can be encoded based on the time difference with respect to the start codes SC. According to the time difference detected, we know which electrode does this signal come from and thereby figure out the touched position. The start code represents the reference point of starting time in above case. In other embodiments, the start code can also be used as the designation of starting of data transmission. Besides, the encoded signal may also include an end code standing for the end of the data transmission or time period. Or, the end code can also be used as the start code of the next cycle; or use the previous signal as the time reference, FIG. 7B also shows a time division multiplexing architecture which directly encodes the electrode numbers instead of the time difference with respect to a reference. For example, the encoded signals $MS_1$~$MS_3$ of the figure correspond to the column electrodes $D_1$~$D_3$, respectively. Different encoded signals, such as "01", "10" and "11" (2 bits coding), are used to present different column electrodes where the encoded signals come from. Accordingly, it is possible to directly determine which column electrode sends out the coupled encoded signal. This approach is not based on the time difference, so the signal transmission sequence can be varied, or a plurality of signals can be transmitted during a single row electrode scanning time for decreasing the number of row electrodes affected by the encoded signals.

Figure 8:
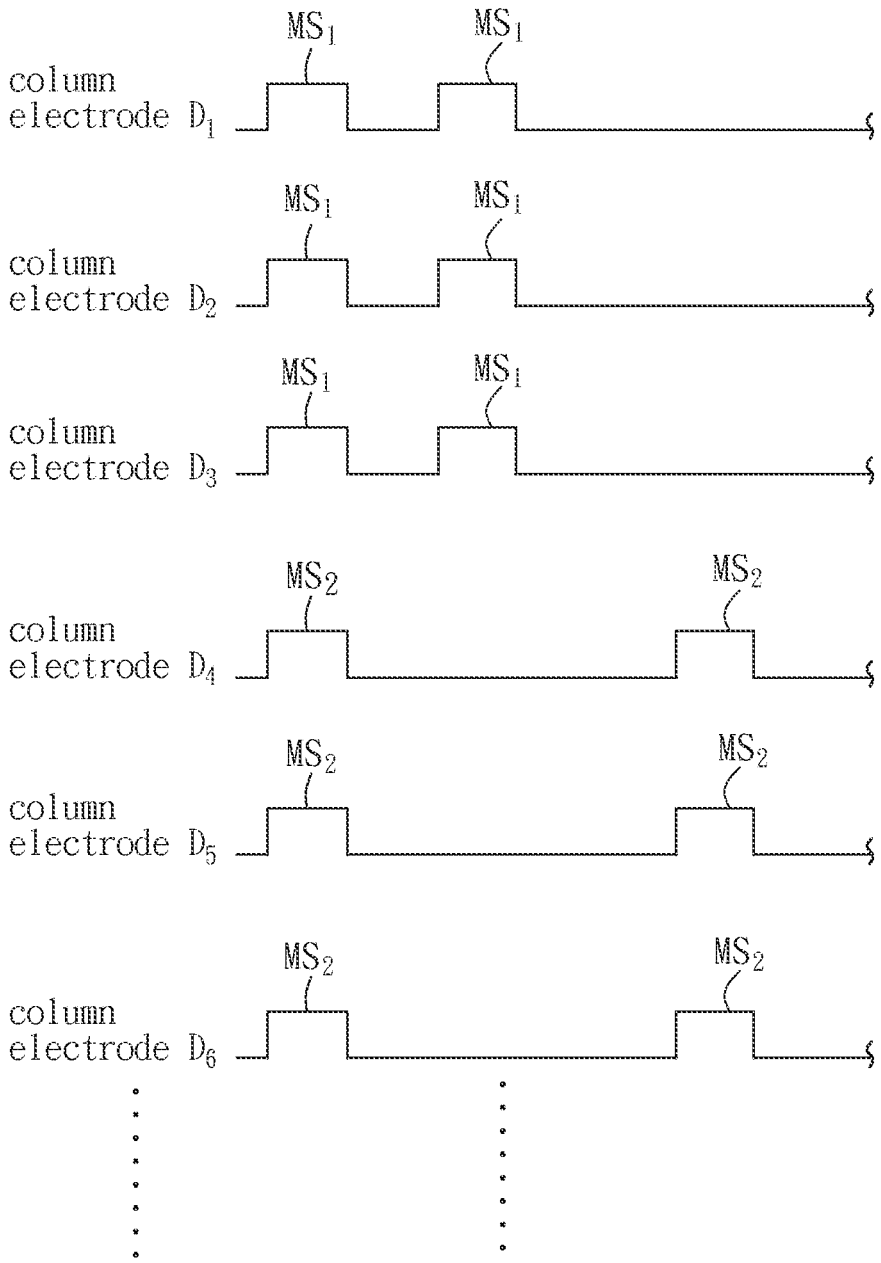

FIG. 8 is a schematic diagram showing the encoded signals that are encoded by groups, wherein the display signals are omitted. Herein, a first group includes the column electrodes $D_1$~$D_3$, a second group includes the column electrodes $D_4$~$D_6$, and so on (each group includes three column electrodes). The first encoded signal transmitted through all the column electrodes $D_1$~$D_6$ are the same time, so it can be used as the start code. Then, from the time differences of the second encoded signal and the first encoded signal in a coupled encoded signal, we can determine which group of the encoded signal comes from. In this case, the encoded signals $MS_1$ transmitted through the column electrodes $D_1$~$D_3$ are the same, and the encoded signals $MS_2$ transmitted through the column electrodes $D_4$~$D_6$ are the same. Accordingly, in the touch input application, the actual amount of the encoded signals received by the operation apparatus 11 can be decreased, thereby increasing the processing speed of the encoded signals.

Figure 9:
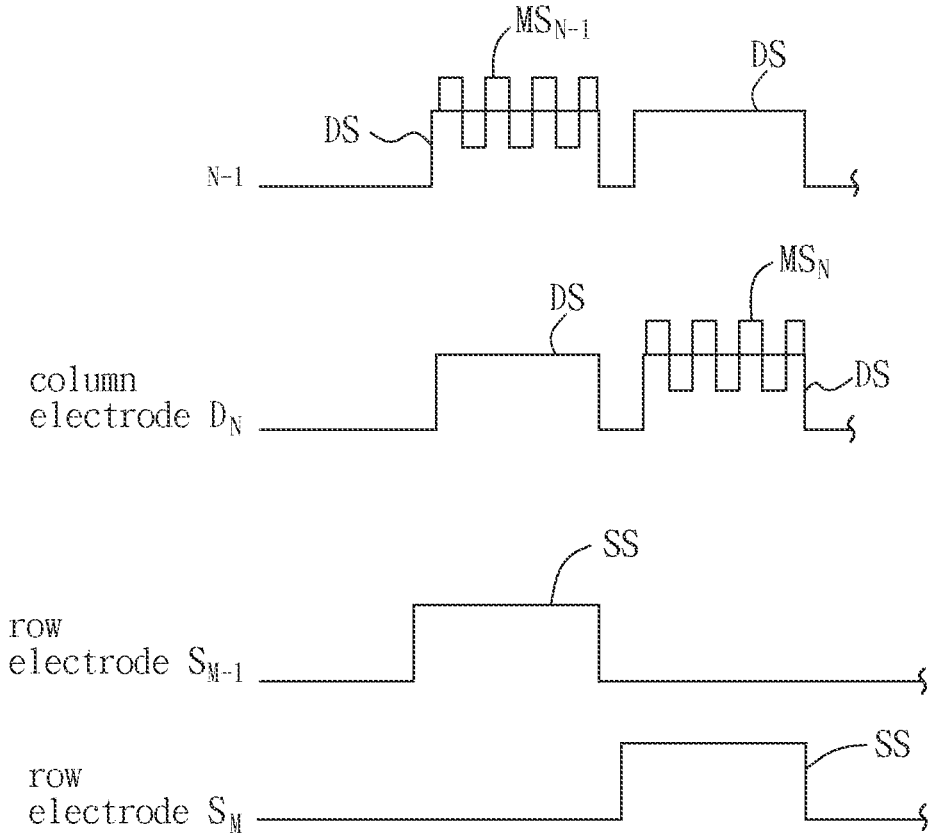

FIG. 9 is a schematic diagram showing the display signals DS carrying the encoded signals. As the column electrodes $D_{N-1}$ and $D_N$ transmit the display signals DS, the encoded signals $MS_{N-1}$ and $MS_N$, which are high frequency signals, are carried on the display signals DS. This embodiment takes time division multiplexing as an example, and of course, the encoded signals can be carried on the display signals DS by FDM (frequency-division multiplexing), CDM (code-division multiplexing) or phase shift keying.

Figure 10:
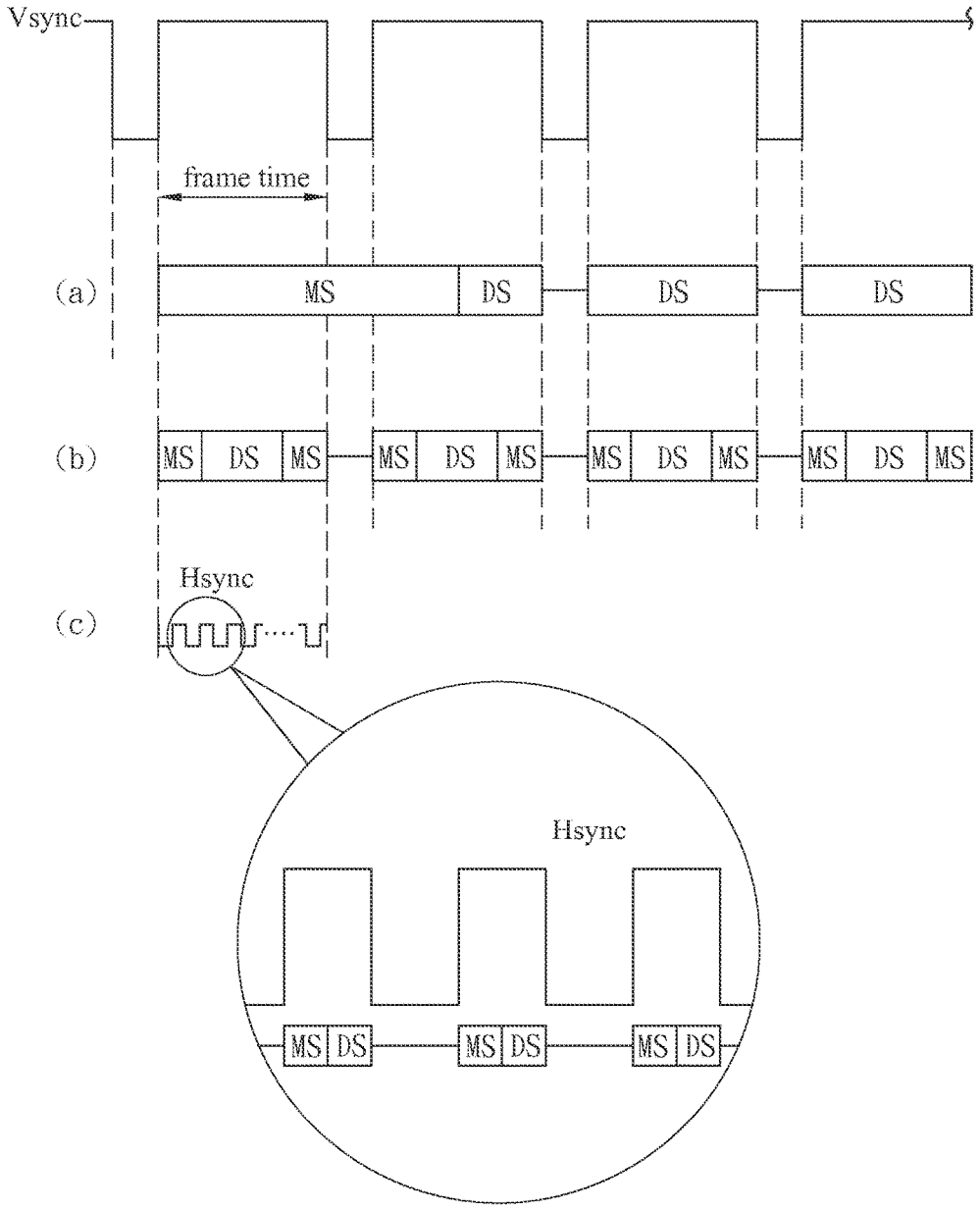

The encoded signals MS are transmitted between the display signals DS, and the detailed description thereof will be illustrated below with reference to FIGS. 10(*a*) to 10(*c*) of FIG. 10. Herein, the vertical sync signal $V_{sync}$ represents the sync signals between the display scenes, and a cycle of the vertical sync signal $V_{sync}$ is a frame time. In FIG. 10(*a*), the encoded signal MS utilizes at least one frame time for transmission, and the display signal DS is not transmitted during this period. After the transmission of the encoded signal MS is finished, the display signal DS is transmitted then. In FIG. 10(*b*), the encoded signal MS and the display signal DS are transmitted during the same frame time. In practice, the display signal DS is compressed and the encoded signal MS is transmitted before or after the display signal DS. In this case, two encoded signals MS are transmitted before and after the display signal DS, respectively. In FIG. 10(*c*), the horizontal sync signal $H_{sync}$ represents the sync signal of each horizontal line of the displayed scene, and a cycle of the horizontal sync signal $H_{sync}$ represents the enable time of one horizontal line in the scene. FIG. 10(*c*) shows that the encoded signals MS and the display signals DS are transmitted in turn during a horizontal line enable period. For example, in order to not affect the displayed scene, the encoded signal MS is transmitted first, and then the display signal DS is transmitted. As mentioned above, FIGS. 10(*a*) to 10(*c*) show that the encoded signals MS and the display signals DS can be alternately transmitted. To be noted, horizontal sync signal $H_{sync}$ is only for synchronizing the operation and the row electrodes can be sequentially enabled (as in traditional display driving method) or non-sequentially enabled.

Figure 11:
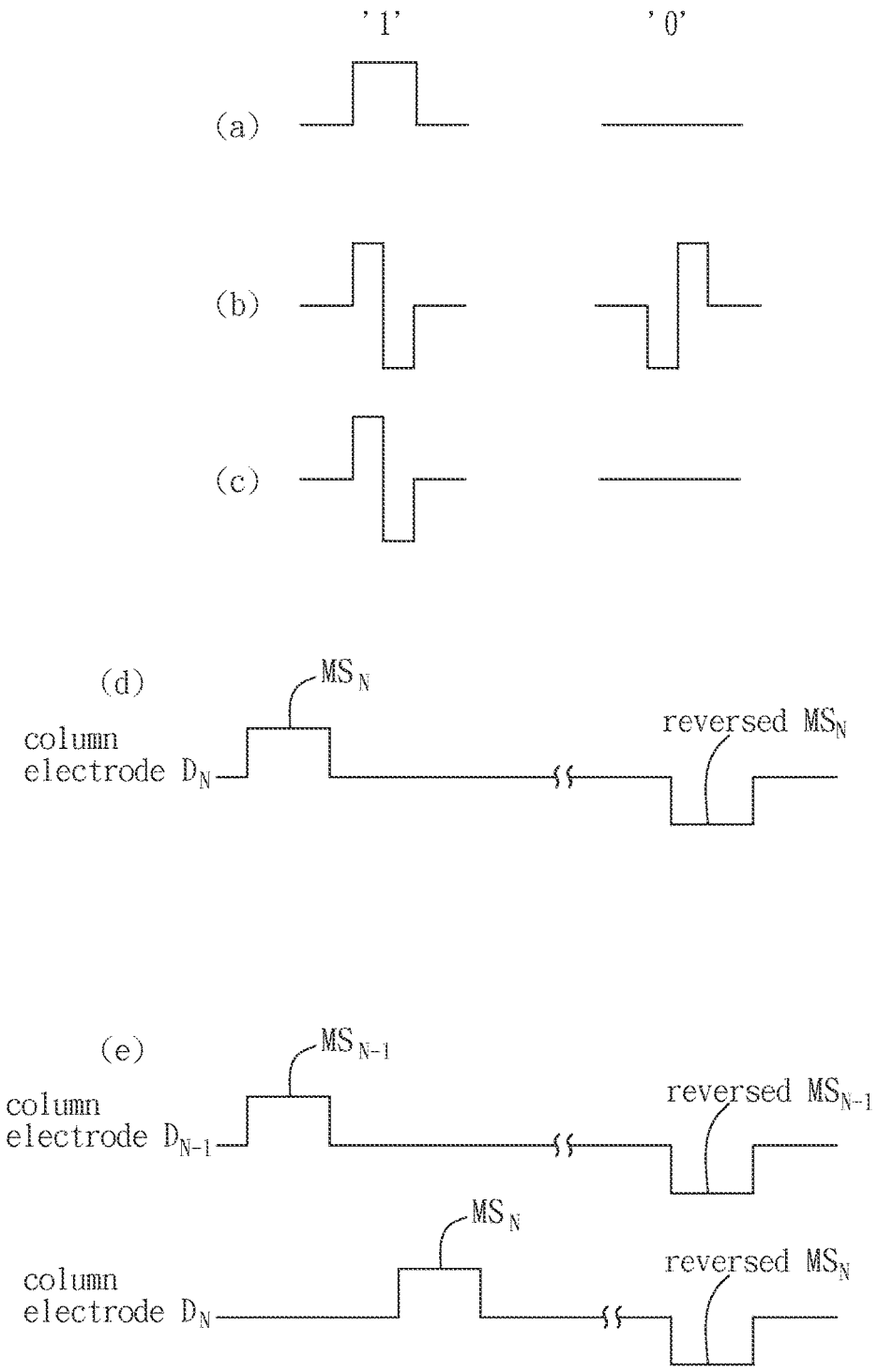

FIG. 11 is a schematic diagram of an AC signal. In any of the above encoding methods, each of '0' and '1' is represented by one signal. For example, as shown in FIG. 11(*a*) of FIG. 11, a pulse represents '1' and no pulse represents '0'. When a signal is applied to a matrix display apparatus, the signal of FIG. 11(*a*) will result in a net DC component (the average within a unit time), which can affect the displayed scene, especially for the LCD panel. Since the liquid crystal molecules will be polarized under a long time positive or negative bias, the liquid crystal molecules will not move easily. In this embodiment, the encoded signals are AC signals, or AC driving, so as to avoid the undesired polarization. Preferably, the average of the encoded signals transmitted through the same column electrode is zero. To prevent the influence upon the display quality, '0' and '1' can be represented by AC signals without any DC content as shown in FIGS. 11(*b*) and 11(*c*) of FIG. 11. Except for the AC signal without any DC content, the above can also be achieved by AC driving method. For example, after transmitting an encoded signal, another encoded signal with reversed waveform can be transmitted later (see FIG. 11(*d*) of FIG. 11). As shown in FIG. 11(*e*) of FIG. 11, the signal with reversed waveform can be collected and transmitted by multiple electrodes at the same time. FIG. 11 is for illustrations only, and typically, the encoded signals using AC signals, or AC driving, can be applied to any of the above mentioned coding methods.

Figure 12:
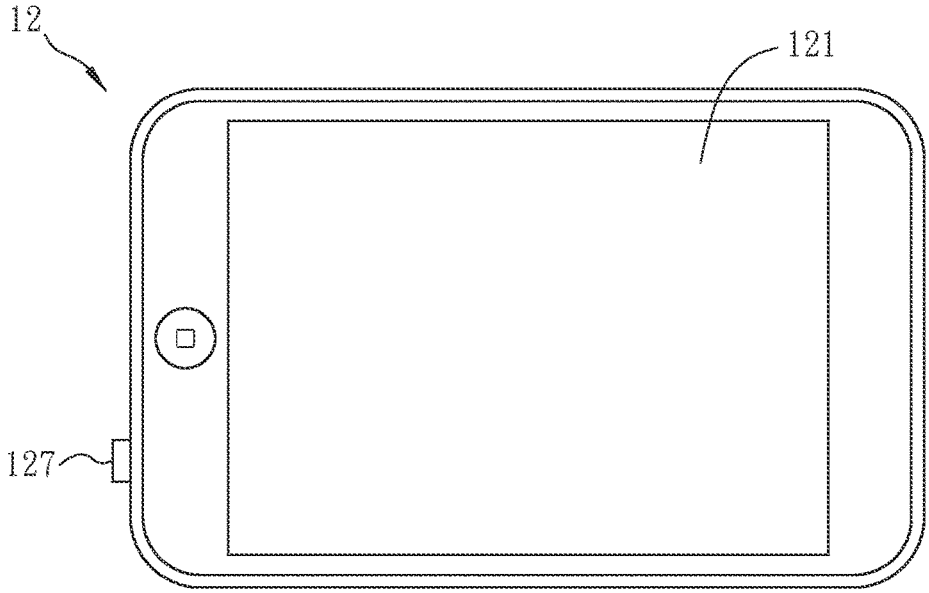
FIG. 12 is a perspective view of the matrix display apparatus of the visual interface system according to the embodiment of the invention.

FIG. 12 is a perspective view of the matrix display apparatus 12 of the visual interface system according to the embodiment of the invention. Referring to FIG. 12, the matrix display apparatus 12 further includes a transmission mode switch 127, and the driving method further includes a step of enabling the matrix display apparatus 12 to enter a transmission mode so as to transmit the encoded signals by triggering the transmission mode switch 127. The transmission mode switch 127 can be a mechanical switch, and the user or operation apparatus triggers the transmission mode switch 127 to enable the matrix display apparatus 12 to enter a transmission mode. Since the column electrodes of the matrix display apparatus 12 need to transmit the display signal and the encoded signal at the same time, the transmission function can be turned off for saving power when the user does not need the touch input function. Besides, this function can be used as protecting the screen from being unintentionally touched. Once the user needs the touch input function, the transmission mode switch 127 is activated for enabling the matrix display apparatus 12 into the transmission mode. Only in this mode, the row electrodes or column electrodes can transmit the encoded signals so as to decrease power consumption. To be noted, the transmission mode switch 127 can be configured on the operation apparatus. In this case, after the switch is activated, the operation apparatus transmits a trigger signal to the matrix display apparatus 12 to control it to enter the transmission mode. To be noted, it is possible to switch to touch input function when the transmission mode switch 127 is activated once by the user or requests the user to keep activating the transmission mode switch 127 to maintain in touch input function.

In summary, a plurality of encoded signals and a plurality of display signals are transmitted on the matrix substrate by the matrix display apparatus, wherein the display signals are used to control the matrix substrate to display images, while the encoded signals can incorporate the touch input function, data transmission function or other functions (e.g. user identification function) into the matrix substrate. When the operation apparatus is operated on the display surface, the encoded signals are coupled from the matrix substrate to the operation apparatus. The encoded signals are then processed to obtain the touch input information, instruction information, identification information, transaction information, or file information. As a result, the visual interface system of the invention can be directly applied to the matrix substrate such as TFT substrate of LCD panel, OLED panel, LED panel, electrophoretic display panel, MEMS display panel, or the likes, thereby making the products lighter, thinner and cheaper so as to increase the product competitiveness. Moreover, the encoded signals are coupled to the external operation apparatus instead of being directly sensed by the matrix substrate, so that it is unnecessary to modify the layout on the matrix substrate. For example, it is unnecessary to add the capacitance sensing components in the display panel for detecting the change of external capacitance values. As a result, the present invention can decrease the manufacturing cost and shrink the process time.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving method of a visual interface system, comprising steps of: transmitting a plurality of encoded signals for signal transmission to an operation apparatus of the visual interface system and a plurality of display signals for image display by at least one of row electrodes and column electrodes of a display matrix of a TFT matrix substrate of a matrix display apparatus of the visual interface system, wherein a display surface of the matrix display apparatus is disposed on one side of a TFT-formed-on substrate of the TFT matrix substrate, wherein the row electrodes, the column electrodes, pixel electrodes and thin film transistors (TFTs) of the display matrix are formed on the other side of the TFT-formed-on substrate of the TFT matrix substrate of the matrix display apparatus, wherein the encoded signals comprise identification information, transaction information, or file information; and receiving at least one of the encoded signals by the operation apparatus operating on the display surface disposed on the one side of the TFT-formed-on substrate of the matrix substrate of the matrix display apparatus, wherein the encoded signals are simultaneously transmitted through the row electrodes or column electrodes of the matrix substrate, and several column electrodes and several row electrodes are set as a group for transmitting the same encoded signals; wherein the encoded signals transmitted through the row electrodes and the encoded signals transmitted through the column electrode are encoded by different coding methods.

2. The driving method of claim 1, wherein the encoded signals are capacitively coupled to the operation apparatus from the matrix substrate.

3. The driving method of claim 1, wherein the encoded signals are modulated by frequency modulation, amplitude modulation, phase modulation, time modulation, or code division multiple access modulation.

4. The driving method of claim 1, wherein part of the column electrodes transmits the same encoded signals.

5. The driving method of claim 1, wherein the encoded signals and the display signals are alternately transmitted.

6. The driving method of claim 5, wherein the encoded signals are transmitted during the breaking time of the display signals.

7. The driving method of claim 5, wherein the encoded signals are transmitted within a display scene.

8. The driving method of claim 1, wherein the encoded signal comprises a start code.

9. The driving method of claim 1, wherein the encoded signal comprises an end code.

10. The driving method of claim 1, wherein the waveform of the encoded signals is an AC (Alternating Current) signal.

11. The driving method of claim 1, further comprising:

enabling the matrix display apparatus into a transmission mode so as to transmit the encoded signals by triggering a transmission mode switch.

12. The driving method of claim 1, further comprising:

obtaining a touch input information according to the encoded signals; and activating the matrix display apparatus according to the touch input information.

13. The driving method of claim 1, further comprising:

activating a transmission mode switch to enable the matrix display apparatus into a transmission mode.

14. A visual interface system, comprising: a matrix display apparatus, comprising:

a TFT-formed-on substrate, having a first side and a second side opposite to the first side;

a display surface, disposed on the first side of the TFT-formed-on substrate; and a display matrix, formed on the TFT-formed-on substrate at the second side of the TFT-formed-on substrate, wherein the display matrix comprises a plurality of row electrodes, a plurality of column electrodes and a plurality of pixel units formed on the second side of the TFT-formed-on substrate, wherein each pixel unit comprises a pixel electrode and a thin film transistor (TFT) formed on the second side of the TFT-formed-on substrate, wherein the row electrodes and column electrodes of the display matrix formed on the second side of the TFT-formed-on substrate are configured to transmit a plurality of display signals to pixel units for displaying images, and at least one of the row electrodes and the column electrodes of the display matrix formed on the second side of the TFT-formed-on substrate is configured to transmit a plurality of encoded signals for signal transmission to the operation apparatus, wherein the encoded signals comprise identification information, transaction information, or file information; and an operation apparatus, configured to receive at least one of the encoded signals by the operation apparatus operating on the display surface disposed on the first side of the TFT-formed-on substrate, wherein the encoded signals are simultaneously transmitted through the row electrodes or column electrodes of the matrix substrate, and several column electrodes and several row electrodes are set as a group for transmitting the same encoded signals; wherein the encoded signals transmitted through the row electrodes and the encoded signals transmitted through the column electrode are encoded by different coding methods.

15. The visual interface system of claim 14, wherein the TFT of each pixel unit is electrically connected to the pixel electrode of each pixel unit, one of the row electrodes and one of the column electrodes.

* * * * *